US006591629B1

(12) United States Patent
Galbreath, Jr.

(10) Patent No.: US 6,591,629 B1
(45) Date of Patent: Jul. 15, 2003

(54) REFRIGERANT RECOVERY SYSTEM HAVING INTEGRATED TWO-PHASE DISTILLATION AND FILTRATION PATH

(75) Inventor: Charles E. Galbreath, Jr., Westlake, LA (US)

(73) Assignee: Galbreath Envirosave, Inc., Waco, TX (US)

( * ) Notice: Subject to any disclaimer, the term of this patent is extended or adjusted under 35 U.S.C. 154(b) by 0 days.

(21) Appl. No.: 10/180,354

(22) Filed: Jun. 26, 2002

(51) Int. Cl.[7] ..... F25B 45/00
(52) U.S. Cl. ..... 62/292; 62/77; 62/85; 62/149
(58) Field of Search ..... 62/77, 85, 149, 62/292, 298, 474

(56) References Cited

U.S. PATENT DOCUMENTS

| | | | | | |
|---|---|---|---|---|---|
| 4,942,741 | A | * | 7/1990 | Hancock et al. | 62/292 |
| 4,969,495 | A | * | 11/1990 | Grant | 141/98 |
| 5,295,367 | A | * | 3/1994 | Keltner | 62/292 |
| 5,617,731 | A | * | 4/1997 | Scaringe | 62/149 |
| 5,873,263 | A | * | 2/1999 | Chang | 62/617 |

* cited by examiner

*Primary Examiner*—Melvin Jones

(57) ABSTRACT

A refrigerant recovery system that includes an accumulator, a storage tank and an integrated two-phase distillation and filtration path interposing the accumulator and the storage tank. The accumulator may be couplable to a system under repair to receive contaminated refrigerant therefrom. The storage tank may be adapted to receive and store processed refrigerant. The integrated two-phase distillation and filtration path may have a vapor filter, a compressor, a radiator and a liquid filter.

20 Claims, 2 Drawing Sheets

REFRIGERANT RECOVERY SYSTEM HAVING INTEGRATED TWO-PHASE DISTILLATION AND FILTRATION PATH

TECHNICAL FIELD OF THE INVENTION

The present invention is directed, in general, to refrigeration processing systems and, more specifically, to a refrigerant recovery system having an integrated two-phase distillation and filtration path.

BACKGROUND OF THE INVENTION

Refrigerant recovery systems are used to prevent the loss of refrigerants in refrigerant systems when the refrigerant has to be removed in order to effect repairs or purify the refrigerant upon contamination. Due to the increase in the cost of refrigerants, as well as the growing concern on the adverse effects that refrigerants discharged into the atmosphere have on the environment, refrigerant recovery systems have been used to remove and store the refrigerants of refrigerant systems under repair. Most refrigerant recovery systems also include some scheme for removing contaminates from the recovered refrigerant before transferring the processed refrigerant into storage or back to the repaired refrigerant system.

Conventional refrigerant recovery systems are often incapable of processing multi-phase refrigerant. Specifically, typical refrigerant recovery systems may be capable of either processing predominantly liquid refrigerant or predominantly vaporous refrigerant, but not multi-phase refrigerant having significant proportions of both liquid and vaporous refrigerant. Accordingly, conventional refrigerant recovery systems typically employ individual processing paths for each refrigerant phase. Most often, refrigerant recovery systems employ a phase separation path, which then splits into two paths: a processing path for purifying predominantly liquid refrigerant, and a another processing path for purifying predominantly vaporous liquid refrigerant. Many refrigerant recovery systems further include an additional processing path for removing solid contaminants from the contaminated refrigerant. However, such refrigerant processing in multiple, single-phase processing paths is time-consuming and complex. It requires additional process control observation and operation, because multiple paths may be processing refrigerant concurrently. Such observation and operation is exceedingly complex, increases the total recovery and recycling time, and can decrease the purity of the recycled refrigerant if numerous process controls are not managed with the utmost scrutiny.

In addition, conventional refrigerant recovery systems typically employ two storage tanks having at least one processing path coupled therebetween. The contaminated or processed refrigerant is cycle back and forth between the two storage tanks, each time undergoing processing to further remove contaminants, such as water, grease, oil and rust. However, while contaminants may be removed from the refrigerant as it flows through the processing path between the storage tanks in one direction, the refrigerant is susceptible to re-contamination as it travels back through the processing path in the opposite direction. Obviously, this also decreases the resulting purity of the recycled refrigerant, and can also decrease the operational life of the refrigerant processing components, such as compressors and purifiers, because the contaminants contribute to the corrosion of the component mechanisms and filters. Additionally, this bi-directional processing path further increases the time required to reach a desired refrigerant purity level, if such a level is even obtainable, because the processed refrigerant is susceptible to re-contamination as it flows back through the processing path.

Accordingly, what is needed in the art is a refrigerant recovery system that avoids the disadvantages associated with multiple-path refrigerant processing, including excessive time consumption, operational complexity and compromised refrigerant purity levels.

SUMMARY OF THE INVENTION

To address the above-discussed deficiencies of the prior art, the present invention provides a refrigerant recovery system having an accumulator couplable to a system under repair to receive contaminated refrigerant therefrom, a storage tank adapted to receive and store processed refrigerant, and an integrated two-phase distillation and filtration path interposing the accumulator and the storage tank. In one embodiment, the integrated two-phase distillation and filtration path includes a vapor filter, a compressor, a radiator and a liquid filter.

The present invention therefore introduces the concept of performing distillation and filtration of refrigerant in the same fluid path. As discussed above, refrigerant recovery systems conventionally require separate paths for distillation of liquid refrigerant and filtration of vaporous or gaseous refrigerant. Accordingly, refrigerant processing conventionally required phase separation followed by processing of single phase refrigerant in multiple fluid paths. The present invention, however, allows two-phase refrigerant to be processed in an integrated distillation and filtration path, thereby eliminating the conventional steps of phase separation and single phase processing.

In one embodiment of the invention, the refrigerant recovery system includes a return path adapted to selectively deliver processed refrigerant from the storage tank to the accumulator. The processed refrigerant may, thus, undergo multiple iterations of integrated distillation and filtration, which may repeat until a desired level of refrigerant purity is obtained. For instance, in one embodiment, the return path may deliver processed refrigerant from the storage tank to the accumulator while an electronic moisture sensor detects moisture in the processed refrigerant above a predetermined amount. Once the moisture in the refrigerant drops below the predetermined amount, the return path may be deselected or closed and the processed refrigerant may be stored for subsequent return to the system under repair or other purposes.

In one embodiment, the integrated two-phase distillation and filtration path may include valves actuated by a programmable logic control system and interposing ones of the vapor filter, compressor, radiator and liquid filter. In one embodiment, the integrated two-phase distillation and filtration path may have an oil separator interposing the compressor and the storage tank.

In one embodiment, the refrigerant recovery system may further include a purge path that transfers refrigerant from the radiator to the compressor. The purge path may have a purge tank, a heater and a vent. The purge path may contribute to the removal of noncondensable contaminants from the refrigerant.

In one embodiment, the integrated two-phase distillation and filtration path may have a header coupled between the radiator, the liquid filter, an electronic moisture sensor and a purge path. The header may increase the flow efficiency between these processing components, thereby decreasing the required processing time required to reach an acceptable level of refrigerant purity.

In one embodiment, the refrigerant recovery system may include a hand-carryable chassis coupled to and supporting the accumulator, storage tank and integrated two-phase distillation and filtration path. For instance, the chassis may fit into a carrying case movable by one or two workers without the assistance of heavy machinery, or the chassis may be adapted to be worn as a backpack by an individual worker.

In one embodiment, the accumulator may receive the contaminated refrigerant at pressures between about 5 psi and about 300 psi. However, one of ordinary skill in the pertinent art understands that receipt or processing of refrigerant at other pressures is within the scope of the present invention.

In one embodiment, the contaminated refrigerant may be three-phase refrigerant (solid, liquid and gas). However, one of ordinary skill in the pertinent art understands that the present invention may be employed to recover myriad refrigerant types under various conditions.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
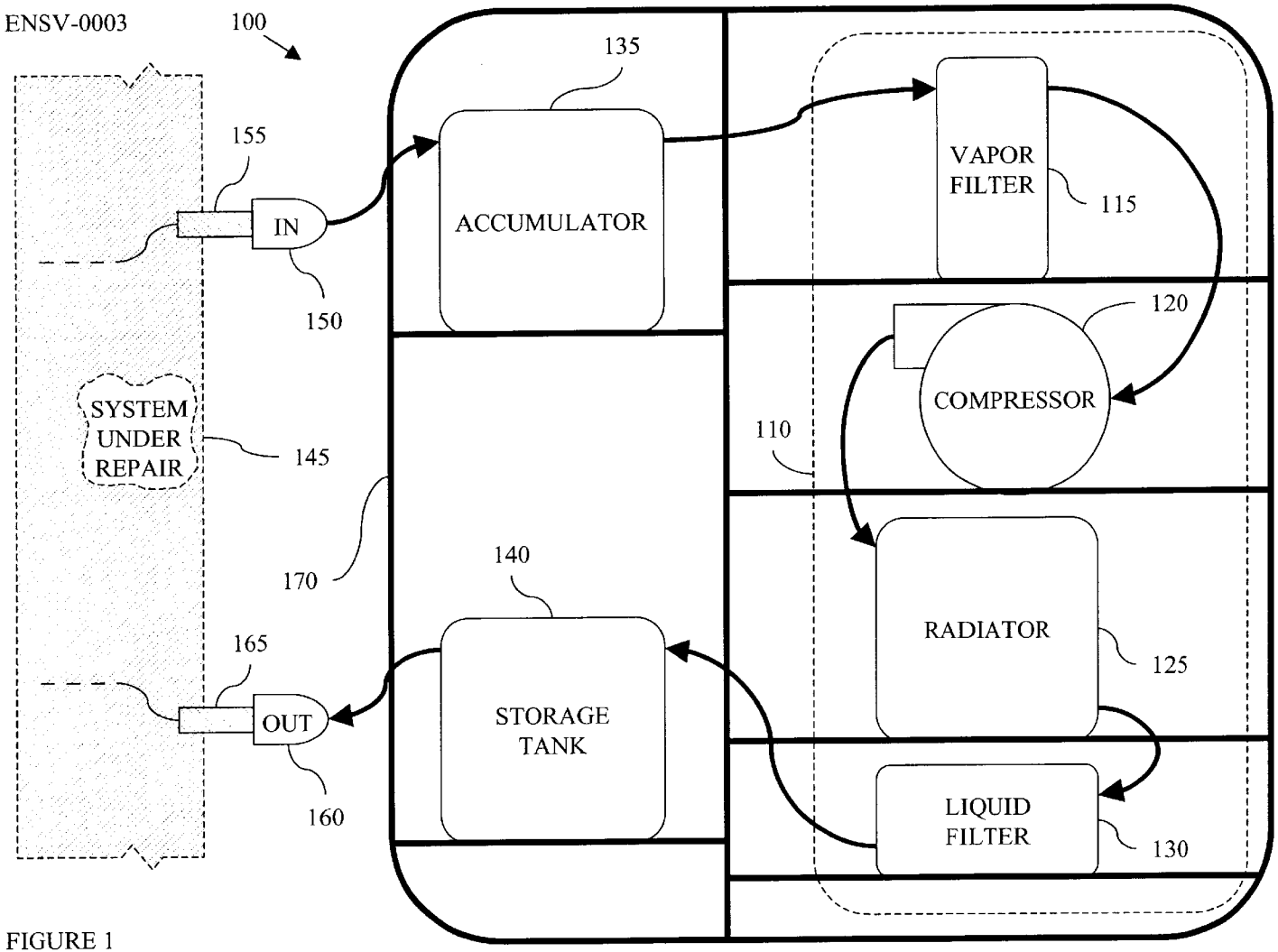
FIG. 1 illustrates an embodiment of a refrigerant recovery system constructed according to the principles of the present invention.

Referring initially to FIG. 1, illustrated is a refrigerant recovery system 100 having an integrated two-phase distillation and filtration ("2PDF") path 110. In one embodiment, the 2PDF path 110 includes a vapor filter 115, a compressor 120, a radiator 125 and a liquid filter 130, and may interpose an accumulator 135 and a storage tank 140. It is intended that a path, such as the 2PDF path 110, is a path for fluid flow and may include a series of processing components connected by various sizes of conduit, as known by those having skill in the pertinent art.

The system 100 is couplable to a system under repair 145, which may be any conventional or later-developed refrigeration system employing predominantly liquid or gaseous refrigerant susceptible to contamination. It is intended that the term coupled may include two items coupled directly to and in contact with one another, as well as two items coupled to but not in direct contact with one another. For example, in the embodiment shown in FIG. 1, the accumulator 135 is coupled to the system under repair 145 via the connection of an inlet connector 150 with a discharge connector 155 by conventional means. Nonetheless, in an alternative embodiment, the accumulator 135 may be directly coupled to the system under repair 145, or have more numerous components interconnected therebetween.

The accumulator 135, which may be a conventional accumulator, receives contaminated refrigerant from the system under repair 145 at a pressure between about 5 psi and about 300 psi in the illustrated embodiment. The refrigerant may be two-phase refrigerant, having a combination of liquid and vaporous refrigerant each in significant proportions. In one embodiment, the refrigerant may be a three-phase substance, having therein additional solid phase refrigerant or contaminants.

In one embodiment, the arrangement of the components included in the 2PDF path 110 may be the vapor filter 115 first, the compressor 120 second, the radiator 125 third and finally the liquid filter 130. However, other component arrangements are within the scope of the present invention, as well as embodiments having additional components. For instance, in one embodiment, the vapor filter 115 may follow the compressor 120 rather than precede it as shown in FIG. 1.

The vapor filter 115 is coupled to the accumulator by conventional means and may be a conventional filter employed to remove vaporous impurities from single- or multi-phase refrigerants, such as a sand sieve or a strainer made of cotton, fine mesh or other conventional materials. In one embodiment, the vapor filter 115 may include two or more filters in series or in parallel with one another, and may have additional components interconnected therebetween.

The compressor 120 is coupled to the vapor filter 115 by conventional means and may be a conventional compressor employed in refrigerant processing. In one embodiment, the compressor 120 may include two or more compressors in series or in parallel with one another, and may have additional processing components interconnected therebetween. The compressor 120 may increase the pressure of the refrigerant to between about 5 psi and about 300 psi in the illustrated embodiment.

The radiator 125 is coupled to the compressor 120 by conventional means and may be a conventional radiator or condenser or other component employed to cool refrigerant. In one embodiment, the refrigerant leaving the compressor 120 may have a significantly raised temperature, and the radiator 125 may operate to allow heat to dissipate from the refrigerant such that contaminants may condense out of the refrigerant.

The liquid filter 130 is coupled to the radiator 125 by conventional means and may be a conventional liquid filter employed to remove liquid contaminants from single- or multi-phase refrigerants, such as R-22 or R-12. However, those having skill in the art understand that the present invention is not limited to designs for or use with R-22 and R-12 refrigerants.

In one embodiment, the liquid filter 130 may include two or more filters in series or in parallel with one another. The liquid filter 130 may be the final component forming the 2PDF path. However, those skilled in the art understand that the 2PDF path may include additional components before or after the liquid filter, and the order of the components discussed above may be rearranged, such embodiments remaining within the scope of the present invention.

The liquid filter 130 is conventionally coupled to the storage tank 140, which, in turn, is conventionally coupled to the system under repair 145. The storage tank 140 may be coupled to the system under repair 145 via the connection of an outlet connector 160 with a recharge connector 165. The storage tank 140 may be a conventional vessel employed to contain and store single-or multi-phase pressurized refrigerant.

As shown in FIG. 1, one embodiment of the present invention may include a hand-carryable chassis 170. The accumulator 135, the storage tank 140 and the 2PDF path and/or the components thereof may be coupled to the chassis 170. By hand-carryable, it is intended that one or two workers may transport the recovery system 100 over moderate distances, such as from a storage location to a work vehicle and then to a job-site, without the assistance of a crane, winch or other lift-assist device. In one embodiment, the weight of the hand-carryable system 100 may be between about 100 lbs and about 250 lbs, and may have an envelope volume between about 6.5 $ft^3$ and about 8.0 $ft^3$ in the illustrated embodiment. Accordingly, in one embodiment, the system 100 may be configured to fit into or have integrated therewith a carrying case, or the system 100 may be configured to be worn as a backpack.

Figure 2:
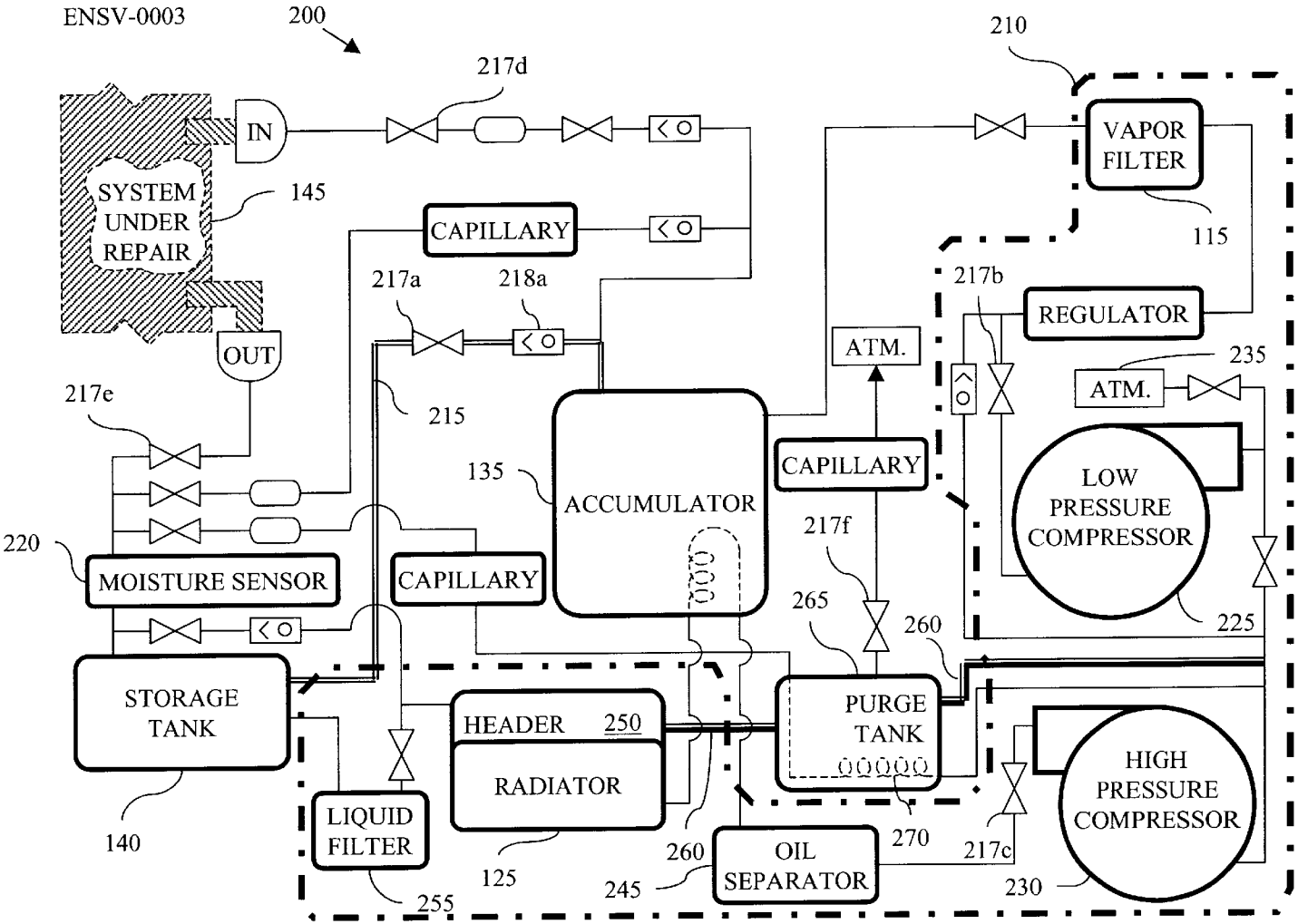
FIG. 2 illustrates another embodiment of a refrigerant recovery system constructed according to the principles of the present invention.

Turning to FIG. 2, illustrated is a refrigerant recovery system 200 constructed according to the principles of the present invention. The system 200 is similar to the system 100 shown in FIG. 1, in that the system 200 includes an integrated 2PDF path 210, an accumulator 135 and a storage tank 140, and is coupled to a system under repair 145. However, the system 200 further includes a return path 215 for delivering processed refrigerant from the storage tank 140 back to the accumulator 135.

The return path 215 may include a control valve 217*a* and a check valve 218*a* coupled to the return path 215. When the control valve 217*a* is open, processed refrigerant is allowed to flow from the storage tank 140 back to the accumulator 135 to be directed through the 2PDF path 210 again. This process may be repeated a predetermined number of times or for a predetermined time period before the control valve 217*a* is closed and the processed refrigerant is contained once again in the storage tank 140.

In one embodiment, the system 200 may include a moisture sensor 220. The moisture sensor 220 may be a conventional sensor used to detect moisture saturation or humidity in a vaporous fluid. However, in another embodiment, the moisture sensor 220 may be an electronic sensor, such as a Wet-Tec™ Electronic Refrigerant Moisture Sensor, commercially available from the Parker Hannifin Corporation. The Wet-Tec™ employs an optic-electronic transducer to recognize color changes in cobalt bromide paper. The color changes are dependent upon the surrounding relative humidity and correspond to a low voltage DC signal output that correlates with a wet or dry system. The moisture sensor 220 may send a indication signal to a computer (not shown) for subsequent process-control use. In one embodiment, rather than closing the return path valve 217*a* after a predetermined time period or number of cycles, the return path valve 217*a* may remain open while the moisture sensor 220 detects moisture in the processed refrigerant above a predetermined amount or, for example, above a predetermined relative humidity. In this manner, the refrigerant may be recycled through the 2PDF path 210 until a desired refrigerant purity is obtained.

In another embodiment, the system 200 may include additional control valves 217 at various locations in the system 200, including between components in the 2PDF path 210. For example, a control valve 217*b* coupled between the vapor filter 115 and a low pressure compressor 225 may permit fluid flow from the vapor filter 115 to the low pressure compressor 225, or the control valve 217*b* may closed so that fluid flow bypasses the low pressure compressor 225. The 2PDF path 210 may also include a valve 217*c* coupled between a high pressure compressor 230 and the radiator 125 and either permit fluid flow from the high pressure compressor 230 to the radiator 125 or prevent such fluid flow, and, instead, direct fluid flow to an atmospheric vent 235. Similarly, a control valve 217*d* may be opened to permit contaminated refrigerant into the system 200 after coupling the accumulator 135 to the system under repair 145, and a control valve 217*e* may be opened to permit recycled refrigerant to flow from the storage tank 140 and recharge the system under repair 145.

In one embodiment, the valves 217 may be conventional, valves, and may be manually-operable. However, in another embodiment, the valves 217 may be automated, and actuated by a programmable logic control system stored in and executed by a computer (not shown). In one embodiment, the programmable logic control system may receive data from instruments included in the system 200, such as the moisture sensor 220. Such data may be used to determine which valves 217 should be opened or closed according to predetermined conditions.

In one embodiment, the system 200 may include an oil separator 245 between the high pressure compressor 230 and the storage tank 140 and coupled to the 2PDF path 210. In another embodiment, the system 200 may include a header 250 coupled to the radiator 125, a liquid filter 255, the moisture sensor 220 and a purge path 260. The header 250 may distribute flow from the radiator 125 among the liquid filter 255, the moisture sensor 220 and the purge path 260.

In one embodiment, the purge path 260 is coupled between the header 250 and the high pressure compressor 230. The purge path 260 may include a purge tank 265. The purge tank 265 may remove noncondensable contaminants from the processed refrigerant. Such contaminants may be expelled from the purge tank 265 through a control valve 217*f*, which may function as a vent through which the noncondensable contaminants may be vented into the surrounding atmosphere. In one embodiment, the purge tank 265 may include a heater 270 integral thereto, and the heater 270 may receive heated refrigerant from the storage tank 140 to contribute to the removal of noncondensable contaminants in the purge tank 265 by heating the refrigerant therein.

Although the present invention has been described in detail, those skilled in the art should understand that they can make various changes, substitutions and alterations herein without departing from the spirit and scope of the invention.

What is claimed is:

1. A refrigerant recovery system, comprising:

an accumulator couplable to a system under repair to receive contaminated refrigerant therefrom;

a storage tank adapted to receive and store processed refrigerant; and an integrated two-phase distillation and filtration path interposing said accumulator and said storage tank and having a vapor filter, a compressor, a radiator and a liquid filter.

2. The refrigerant recovery system as recited in claim 1, further comprising a return path adapted to selectively deliver processed refrigerant from said storage tank to said accumulator.

3. The refrigerant recovery system as recited in claim 2, wherein said return path delivers processed refrigerant from said storage tank to said accumulator while an electronic moisture sensor detects moisture in said processed refrigerant above a predetermined amount.

4. The refrigerant recovery system as recited in claim 1, wherein said integrated two-phase distillation and filtration path further has valves actuated by a programmable logic control system and interposing ones of said vapor filter, compressor, radiator and liquid filter.

5. The refrigerant recovery system as recited in claim 1, wherein said integrated two-phase distillation and filtration path further has an oil separator interposing said compressor and said storage tank.

6. The refrigerant recovery system as recited in claim 1, further comprising a purge path that transfers refrigerant from said radiator to said compressor and having a purge tank, a heater and a vent.

7. The refrigerant recovery system as recited in claim 1, wherein said integrated two-phase distillation and filtration path further has a header coupled between said radiator, said liquid filter, an electronic moisture sensor and a purge path.

8. The refrigerant recovery system as recited in claim 1, further comprising a hand-carryable chassis coupled to and supporting said accumulator, storage tank and integrated two-phase distillation and filtration path.

9. The refrigerant recovery system as recited in claim 1, wherein said accumulator receives said contaminated refrigerant at pressures between about 5 psi and about 300 psi.

10. The refrigerant recovery system as recited in claim 1, wherein said contaminated refrigerant is three-phase refrigerant.

11. A refrigerant recovery process, comprising:

receiving contaminated refrigerant from a system under repair into an accumulator coupled to said system under repair;

storing processed refrigerant in a storage tank; and processing refrigerant in an integrated two-phase distillation and filtration path interposing said accumulator and said storage tank, said integrated path having a vapor filter, a compressor, a radiator and a liquid filter.

12. The refrigerant recovery process as recited in claim 11, further comprising selectively delivering processed refrigerant from said storage tank to said accumulator via a return path.

13. The refrigerant recovery process as recited in claim 12, wherein said selectively delivering further comprises selectively delivering while an electronic moisture sensor detects moisture in said processed refrigerant above a predetermined amount.

14. The refrigerant recovery process as recited in claim 11, wherein said integrated two-phase distillation and filtration path further has valves actuated by a programmable logic control system and interposing ones of said vapor filter, compressor, radiator and liquid filter.

15. The refrigerant recovery process as recited in claim 11, wherein said integrated two-phase distillation and filtration path further has an oil separator interposing said compressor and said storage tank.

16. The refrigerant recovery process as recited in claim 11, further comprising transferring refrigerant from said radiator to said compressor via a purge path having a purge tank, a heater and a vent.

17. The refrigerant recovery process as recited in claim 11, wherein said integrated two-phase distillation and filtration path further has a header coupled between said radiator, said liquid filter, an electronic moisture sensor and a purge path.

18. The refrigerant recovery process as recited in claim 11, further comprising supporting said accumulator, storage tank and integrated two-phase distillation and filtration path by a hand-carryable chassis coupled thereto.

19. The refrigerant recovery process as recited in claim 11, wherein said receiving includes receiving said contaminated refrigerant at pressures between about 5 psi and about 300 psi.

20. The refrigerant recovery process as recited in claim 11, wherein said receiving includes receiving three-phase refrigerant.

* * * * *